United States Patent [19]

Matsumoto et al.

[11] 4,446,789

[45] May 8, 1984

[54] DOT MATRIX PRINTER

[75] Inventors: Michio Matsumoto; Masao Kitamura, both of Tokyo; Masataka Ohta; Takeshi Ohshima, both of Kanagawa, all of Japan

[73] Assignees: Nippon Electric Co., Ltd.; Nippon Telegraph & Telephone Public Corporation, both of Tokyo, Japan

[21] Appl. No.: 326,319

[22] Filed: Dec. 1, 1981

[30] Foreign Application Priority Data

Dec. 1, 1980 [JP] Japan ..... 55-169286

[51] Int. Cl.[3] ..... B41J 3/12

[52] U.S. Cl. ..... 101/93.04; 400/121; 400/320

[58] Field of Search ..... 400/328, 121, 124, 320; 101/93.48, 93.04, 93.05

[56] References Cited

U.S. PATENT DOCUMENTS 3,993,181 11/1976 Potma et al. ..... 400/124

4,306,497 12/1981 Hamada ..... 400/124 X

OTHER PUBLICATIONS

*IBM Tech. Disc. Bulletin,* by F. Hilpert, vol. 11, No. 2, July 1968, p. 214.

*Primary Examiner*—Paul T. Sewell

*Attorney, Agent, or Firm*—Sughrue, Mion, Zinn, Macpeak, and Seas

[57] ABSTRACT

A dot matrix printer having a printer hammer bank carried on a frame to allow movement parallel to the platen. A balancing member is suspended from the head hammer bank by resilient springs and carries a motor for driving the head hammer bank in a reciprocating manner. A linkage further couples the head hammer bank and the balancing member so that the balancing member moves in a direction opposite to that of the head hammer bank.

11 Claims, 3 Drawing Figures

DOT MATRIX PRINTER

BACKGROUND OF THE INVENTION

This invention relates to a dot matrix printer and, more particularly to improvement of its carriage assembly including a printer hammer bank which comprises a plurality of printer hammers aligned in the direction perpendicular to feeding direction of a paper set on the platen of the printer to be printed.

The dot matrix printer is able to perform high speed operation to print various kinds of characters. It has become popular to use the type of printer as an output means for systems such as a computer or the like.

As is known well, the printing speed of such a printer is basically determined by two factors. One is a period required for one reciprocation of the printer hammer bank and the other is a period required for repetitive printing motion of printer hammers which are aligned in parallel with each other on the printer head. To realize high speed operation, therefore, shortening of both of these periods is required. It should be noted, however, that the printer head contains a lot of components itself, thus resulting in a considerably large inertia when the head is moving. Accordingly, the faster the printer is operated, more undesirable vibration is caused and noise also increases.

To solve the problem of high speed operation of the printer, an improved printer was proposed in the copending application Ser. No. 55,476 entitled "A Dot Matrix Type Printer" and filed on July 6, 1979, now U.S. Pat. No. 4,306,497 issued on Dec. 22, 1981. In the proposed printer, a carriage assembly includes a printer hammer bank which comprises a plurality of printer hammers aligned immediately before a sheet of paper set on a platen to be printed and in a direction perpendicular to a feeding direction of the paper, a balancing means, a first resilient member connecting the balancing means with the printer hammer bank, and a second resilient member connecting the balancing means with a printer frame. The printer hammer bank is driven to reciprocate in the direction perpendicular to the paper feeding direction by a driving source fixed to the printer frame. The balancing means has a mass matching with that of the printer hammer bank to suppress generation of vibration and noise due to the reciprocation of the printer hammer bank during the operation of the printer. Therefore, it is quite difficult to design a small-sized and light-weight printer.

SUMMARY OF INVENTION

It is, therefore, an object of this invention to provide a dot matrix printer with a small-sized and light weight printer carriage assembly.

According to this invention, there is provided a dot matrix printer including a printer carriage assembly in which a printer hammer bank is coupled via a resilient member to a balancing means on which a driving source is provided for driving the print hammer bank to reciprocate in a direction perpendicular to a feeding direction of a paper to be printed.

In a printer according to this invention, a combined mass of the balancing means and the driving source is determined to match with a mass of the printer hammer bank. The provision of the driving source on the balancing means makes it possible to reduce the mass of the balancing means itself by a mass of the driving source, thereby to lighten the weight of the printer as a whole.

Also a decrease of the size of the printer occurs by the volume of the driving source and the reduced amount of the balancing means.

BRIEF DESCRIPTION OF THE DRAWING

The features and advantages of this invention will be understood from the detailed description of a preferred embodiment of this invention taken in conjunction with the accompanying drawings, wherein.

DESCRIPTION OF THE PREFERRED EMBODIMENT

Figure 1:
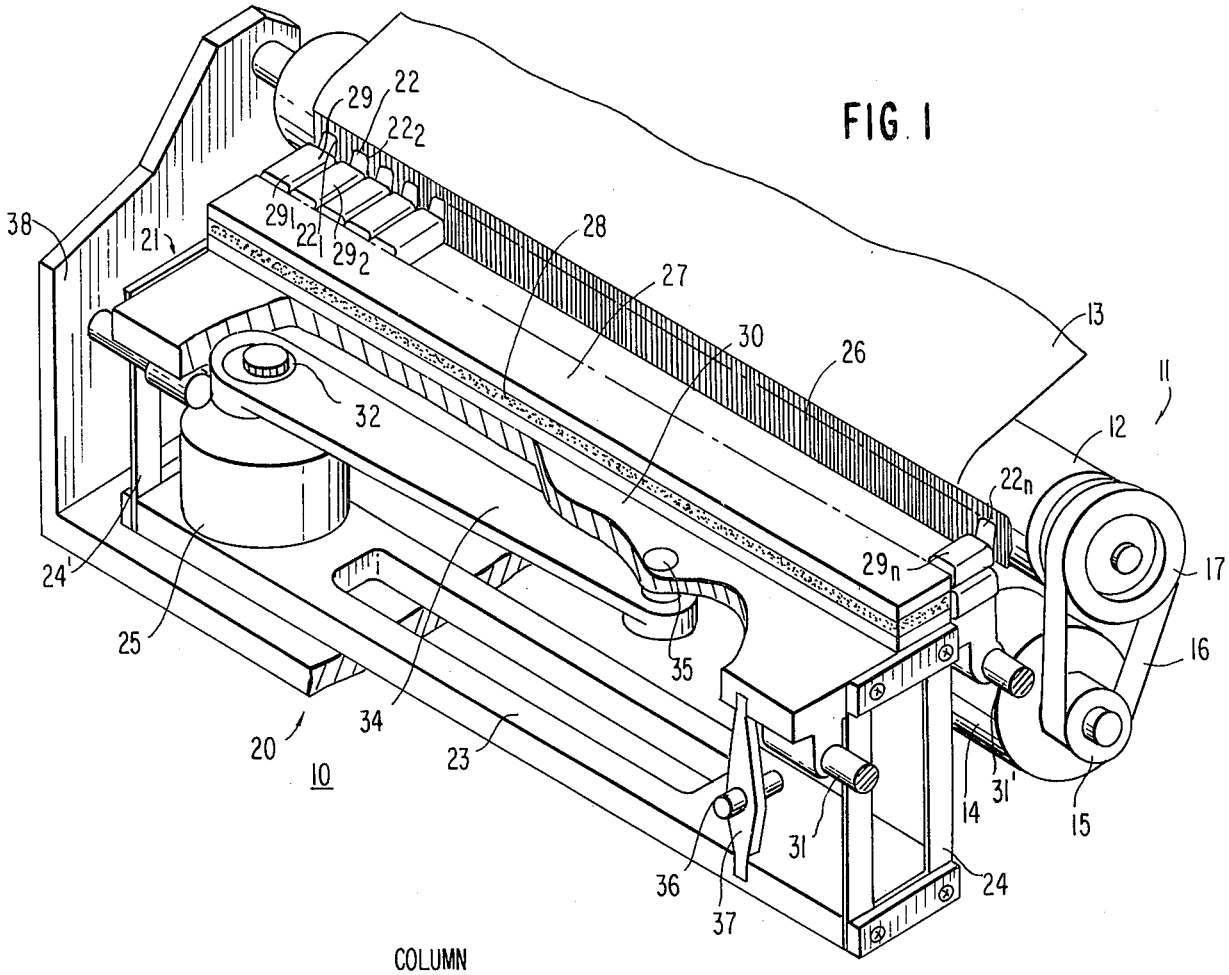
FIG. 1 is a perspective view of the essential part of the dot matrix printer embodying the present invention, in which partial breaking away is done for showing the inside of the structure.

FIG. 1 shows an embodiment of the present invention and, especially, shows the essential part of the printing mechanism which directly concerns with the present invention. In FIG. 1, the entire printer is designated by a reference numeral 10 and has a paper feeding mechanism 11 which comprises a platen 12 for feeding a sheet of paper 13 being set thereon, and a paper driving motor 14 for driving the platen 12 through a motor pulley 15, a belt 16 and a platen pulley 17.

The printer 10 further contains a carriage assembly 20 which comprises a slender plate shaped printer bank 21 on which a plurality of printer hammers $\mathbf{22}_1$ through $\mathbf{22}_n$ are mounted; a balancing means 23 which is positioned under the printer hammer bank 21; plate springs 24 and 24' which connect the printer hammer bank 21 with the balancing means 23; a driving motor 25 which is fixed on the balancing means 23 and adapted to reciprocate the printer hammer bank 21 in the direction across (perpendicular to, in this example) the feeding direction of the paper 13; and an inked ribbon 26 which is disposed between the carriage assembly 20 and the paper feeding mechanism 11.

The printer hammer bank 21 is composed of a plurality of plate spring type print hammers $\mathbf{22}_1$ through $\mathbf{22}_n$ made of ferromagnetic material; a yoke 27 having a slender yoke portion and a comb portion; a permanent magnet 28 provided in the yoke portion; a plurality of coils $\mathbf{29}_1$ through $\mathbf{29}_n$ provided in the comb portion for driving the print hammers $\mathbf{22}_1$ through $\mathbf{22}_n$, respectively; and a hammer bank frame 30 for supporting the yoke 27. A combination of the printer hammers 22 and the coils 29 is aligned on the yoke 27 keeping an equal interval therebetween. When a signal is given to the coils 29 from a driving circuit (not shown), the printer hammers 22 are driven out toward the paper 13 to mark one dot thereon with the help of the inked ribbon 26. The hammer bank 21 is supported on two guide shafts 31 and 31' fixed to a printer frame 28 to reciprocate in the direction perpendicular to the paper feeding direction (i.e. the direction from the right to the left or vice versa). The span of reciprocation of the printer hammer bank 21 is designed to be nearly equal to the interval between printer hammers 22.

The reciprocation of the hammer bank 21 is driven by the driving motor 25 provided on the balancing means 23. An eccentric cam 32 is connected to a shaft 33 of the motor 25. A crank 34 is provided for transmitting the eccentric movement of the cam 32 to the hammer bank 21. One end portion of the crank 34 is pivotally coupled to the eccentric cam 32, and the other end portion to an axis 35 on the frame 30 of the hammer bank 21, to reciprocate the hammer bank with a reciprocating span equal to an eccentricity A of the eccentric cam 32. Further, the printer hammer bank 21 and the balancing means 23 are swingingly connected to each other through a connecting lever 36, an pin 37 of which is connected to the printer frame 38. The connecting lever 36 effectively works to force the hammer bank 21 and the balancing means 23 to swing relative to each other in a completely opposite phase with respect to the fixed pin 37. Instead of the lever 36, other linking means may be used, which includes a pinion gear coupling with racks provided respectively to the hammer bank 21 and the balancing means 23 and rotating around an axis attached to the frame 38.

Figure 2A:
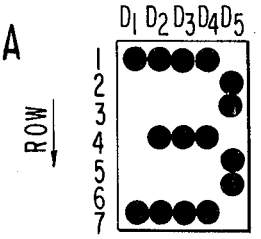
FIGS. 2A and 2B show the dot formation for printing for use in the printer shown in FIG. 1 and movement of the printer hammer in printing operation respectively.
Figure 2B:
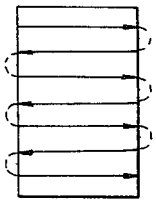

Operation of the embodiment will now be explained in connection with FIGS. 2A, 2B and 3. In the following explanation, it is assumed that the printer is defined by 5×7 matrix. According to such a matrix, a numeral "3" is written as shown in FIG. 2A by means of a dot group. This dot group is formed by reciprocating or scanning (hereinafter these terms are used interchangeably) the hammer bank 21 in the manner as show in FIG. 2B. More particularly, the printer hammer bank 23 starts the left end of the first line to travel on it and then, it reverses its travelling direction at the right end of the first line to travel through the second line from the right to the left thereof. It again reverses its travelling direction at the end of its second travel on the second line to enter into its third travel on the third line from the left to the right thereof. The printer hammer bank 23 repeats same movement as above until scanning over the entire character is completed. During the movement of the printer hammer bank 23 like the above, the printer hammer is operated when even it arrives at every position where printing is to be done, so that the attempted character, a numeral "3" in this instance is printed.

Figure 3:
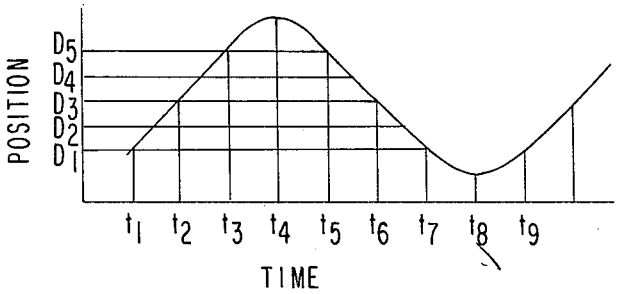
FIG. 3 is a diagrammatical representation to show relation of time vs. printer hammer position in its reciprocation.

The printing operation as mentioned above will be more fully understood from the following explanation taken in conjunction with FIG. 3 showing the relation between time and the printer hammer bank position that changes according to time. At the time $t_1$ the printer hammer of the printer hammer bank 23 is at position D1 which corresponds to the dot at the leftest upper corner of FIG. 2A. When time changes to $t_2$ and then, to $t_3$, the printer hammer moves to the right to take the positions D2, D3 and D4, and then reaches the position D5 at the time $t_3$.

The numeral "3" as shown in FIG. 2A is printed through the following process. On the first line, dot printing is carried out at each of positions D1 through D4 but not at the position D5 for the period $t_1$ through $t_3$. Then, the printing hammer bank 23 is quickly turned by the driving source 25 to get back to the position D5 again at the time $t_5$. During this period, the paper feeding motor 15 acts to feed the paper 13 upwardly by one line interval, thus the printer hammer bank 23 being placed at the right end of the second line. Then, the printer head is made to travel to the left along the second line and arrives at D1 i.e. the left end of the second line as shown in FIG. 2B, at the time $t_7$. During this travel of the printer hammer bank, dot printing is executed at D5 but not at any of D4 through D1. In the manner like the mentioned above, the printer hammer bank repeats its traveling over lines to complete the scanning as shown in FIG. 2B, during which dot printing is executed at desired positions to write a desired character, "3" in this instance.

In the embodiment, assuming that displacement and a mass of the hammer bank 21 are represented by $X_1$ and $M_1$, respectively, displacement and a combined mass of the balancing means 23 and the motor 25, by $X_2$ and $M_2$, a spring constant of the plate springs 24 and 24' by K, and a rotational speed of the motor 25 by N, the displacements are as follows:

$$X_1 = A\frac{M_2}{M_1 + M_2}\sin 2\pi Nt, \text{ and } X_2 = A\frac{M_1}{M_1 + M_2}\sin 2\pi Nt,$$

that is, $X_1/X_2 = M_2/M_1$. Therefore, when a lever ratio of the lever 36 (a ratio between distances from the axis 37 to the bank frame 30 and the balancing means 23) is determined to $M_2/M_1$, the center of gravity for the combined system of the hammer bank 21, the balancing means 23 and the motor 25 is not swung, thereby not transmitting the reciprocation to the printer frame 37.

Assuming that the driving force acting upon the hammer bank 23 and the resistance due to friction are represented by F and $F_o$, respectively, the force is as follows:

$$F = A_o\left\{K - (2\pi N)^2\frac{M_1 M_2}{M_1 + M_2}\right\}\sin 2\pi t + F_o$$

Therefore, when the factors K, $M_1$ and $M_2$ are determined to satisfy the following relationship.

$$N = \frac{1}{2\pi}\sqrt{K\left(\frac{1}{M_1} + \frac{1}{M_2}\right)},$$

the force F becomes to equal to the resistance $F_o$, i.e., $F = F_o$. This means that it is possible to drive the hammer bank 23 by an extremely small driving force.

Because $M_2$ is the combined mass of the balancing means 23 and the motor 25, it is possible to make the mass of the balancing means 23 less than the balancing mass $M_2$ by the mass of the motor 25. Accordingly, the total weight of the printer can be lightened by the weight of the motor 25 and further, the size of the printer can be reduced to an extent of the reduced volume of the balancing means 23 plus the volume of the motor 25 which has been positioned outside the space between the hammer bank 21 and the balancing means 23 in the prior art.

What is claimed is:

1. A dot matrix printer comprising:

a printer frame;

means for feeding paper to be printed;

a printer hammer bank mounted on said frame having a plurality of printer hammers aligned on said hammer bank;

balancing means;

a resilient member for connecting said balancing means to said hammer bank; and means provided on said balancing means for driving said hammer bank to reciprocate in a direction orthogonal to a feeding direction of said paper, wherein the combined mass of said balancing means and said means for driving is matched to the mass of said print hammer bank.

2. A dot matrix printer as claimed in claim 1, further comprising means for swinging said hammer bank and said balancing means in an opposite phased relationship to each other.

3. A dot matrix printer as claimed in claim 1, wherein said driving means comprises a motor having an output shaft fixed to said balancing means, a crank coupled to said shaft of said motor, and a crank member for transmitting an movement of said crank to said hammer bank.

4. A dot matrix printer as claimed in claim 3, wherein one end portion of said crank member is pivotally coupled to said eccentric cam and the other end is coupled to a pin provided on said hammer bank.

5. A printer comprising an alongated platen, a frame, a printer hammer bank, printer hammer bank carrying means, means carried by said frame for supporting said printer hammer bank carrying means such that said printer hammer bank carrying means may be moved along a direction parallel to said elongated platen, balancing means positioned under said printer hammer bank carrying means with a space therebetween, means to elastically connect said printer hammer bank carrying means and said balancing means, driving means fixed to said balancing means and positioned in said space for driving said printer hammer bank carrying means to reciprocate said printer hammer bank carrying means along the direction parallel to said platen, the combined mass of said balancing means and said driving means matched to the mass of said print hammer bank, and linking means fixed to said frame and movably connected to said printer hammer bank carrying means and said balancing means.

6. The dot matrix printer of claim 1, wherein said resilient member comprises a pair of plate springs disposed at ends of said balance means to connect said balance means in a spaced arrangement from said hammer bank.

7. The dot matrix printer of claim 2, wherein said means for swinging said hammer bank and said balancing means in opposite directions comprises a lever coupled to both said balancing means and said hammer bank and a pin through said lever connected to said printer frame, whereby said lever pivots about said pin to move said balancing means in response to movement of said hammer block in a direction opposite thereto.

8. The printer of claim 5, wherein said means to elastically connect said printer hammer bank carrying means and said balancing means comprises a pair of plate springs disposed at ends of said balancing means and said printer hammer bank carrying means and coupled thereto to flexibly connect said balancing means and said printer hammer bank carrying means.

9. The printer of claim 5, wherein said linking means comprises a lever mounted on a pin fixed to said frame, said lever coupled to said balancing means and said printer hammer bank carrying means and pivotable about said pin to drive said balancing means in a direction opposite to the direction of travel of said printer hammer bank carrying means.

10. The printer of claim 5, wherein said driving means comprises a motor having an output shaft with a crank element coupled thereto, and a crank member for transmitting movement of said crank to said printer head hammer bank carrying means.

11. A dot matrix printer comprising:

a frame;

a printer hammer bank mounted for movement relative to said frame;

balancing means resiliently carried by said frame, motor means for driving said printer hammer bank in a reciprocating manner, and means pivotable about a pin mounted on said frame to swing said balance means in a direction opposite to that of said printer hammer bank, the combined mass of said balance means and said means for driving being matched with the mass of said printer hammer bank.

* * * * *

UNITED STATES PATENT AND TRADEMARK OFFICE

CERTIFICATE OF CORRECTION

PATENT NO. : 4,446,789

DATED : May 8, 1984

INVENTOR(S) : Matsumoto et al

It is certified that error appears in the above-identified patent and that said Letters Patent is hereby corrected as shown below:

On the title page in the abstract:

Line 3, delete "head",

Line 5, delete "head",

Line 6, delete "head",

Line 9, delete "head",

Signed and Sealed this

*Eighteenth* Day of *December 1984*

[SEAL]

*Attest:*

*Attesting Officer*

GERALD J. MOSSINGHOFF

*Commissioner of Patents and Trademarks*